US010145368B2

(12) United States Patent
Iwanaji

(10) Patent No.: US 10,145,368 B2
(45) Date of Patent: Dec. 4, 2018

(54) PUMP VOLUME CONTROL APPARATUS

(71) Applicant: KAYABA INDUSTRY CO., LTD., Tokyo (JP)

(72) Inventor: Tetsuya Iwanaji, Kanagawa (JP)

(73) Assignee: KYB Corporation, Tokyo (JP)

( * ) Notice: Subject to any disclaimer, the term of this patent is extended or adjusted under 35 U.S.C. 154(b) by 563 days.

(21) Appl. No.: 14/654,850

(22) PCT Filed: Jan. 7, 2014

(86) PCT No.: PCT/JP2014/050052
§ 371 (c)(1),
(2) Date: Jun. 23, 2015

(87) PCT Pub. No.: WO2014/156207
PCT Pub. Date: Oct. 2, 2014

(65) Prior Publication Data

US 2015/0337813 A1 Nov. 26, 2015

(30) Foreign Application Priority Data

Mar. 28, 2013 (JP) ..... 2013-070059

(51) Int. Cl.
*F04B 1/32* (2006.01)
*F04B 49/00* (2006.01)
(Continued)

(52) U.S. Cl.
CPC ..... *F04B 1/324* (2013.01); *F04B 1/2078* (2013.01); *F04B 49/002* (2013.01); *F04B 49/08* (2013.01); *F04B 2205/06* (2013.01)

(58) Field of Classification Search
CPC ..... F04B 1/146; F04B 1/2078; F04B 1/295; F04B 1/324; F04B 23/10; F04B 27/086;
(Continued)

(56) References Cited

U.S. PATENT DOCUMENTS 4,599,050 A * 7/1986 Ishizaki ..... F04B 1/324 417/216
5,273,403 A * 12/1993 Im ..... F04B 1/324 417/213
(Continued)

FOREIGN PATENT DOCUMENTS

JP 07189917 A * 7/1995
JP H07-189917 A 7/1995
(Continued)

*Primary Examiner* — Kenneth J Hansen
*Assistant Examiner* — Chirag Jariwala
(74) *Attorney, Agent, or Firm* — Rabin & Berdo, P.C.

(57) ABSTRACT

A pump volume control apparatus includes: a tilting piston; a pump volume switching valve configured to adjust a tilt driving pressure by a movement of a spool; a flow rate control spring configured to bias the spool in accordance with a tilt angle; a horsepower control piston configured to move in accordance with a pump discharge pressure; and a horsepower control spring configured to bias the horsepower control piston in accordance with the tilt angle. The tilt driving pressure is adjusted by means of the movement of the spool in accordance with a force acting on the spool in response to a flow rate controlling signal pressure in a flow rate controlled state, and is adjusted by means of the movement of the spool in accordance with a force acting on the horsepower control piston in response to the pump discharge pressure in a horsepower controlled state.

10 Claims, 10 Drawing Sheets

(51) Int. Cl.
*F04B 49/08* (2006.01)
*F04B 1/20* (2006.01)

(58) Field of Classification Search
CPC ..... F04B 27/22; F04B 49/002; F04B 49/08; F04B 49/12; F04B 2205/06; F04B 2205/18; F15B 13/042; F15B 2211/329; F15B 2211/355; F16K 11/07; F16K 11/0712; F16K 31/1221; F16K 31/124; Y10T 137/86582; Y10T 137/8671
USPC ..... 417/213, 218
See application file for complete search history.

(56) References Cited

U.S. PATENT DOCUMENTS

| | | | | |
|---|---|---|---|---|
| 9,206,798 | B2 * | 12/2015 | Jung | E02F 9/2235 |
| 2015/0226190 | A1 * | 8/2015 | Sakai | F04B 1/295 417/218 |

FOREIGN PATENT DOCUMENTS

| | | | | |
|---|---|---|---|---|
| JP | 10122153 | A | * | 5/1998 |
| JP | H10-184556 | A | | 7/1998 |
| JP | 2801091 | B2 | * | 9/1998 |
| JP | 10-281073 | A | | 10/1998 |
| JP | 11-148463 | A | | 6/1999 |
| JP | 11148463 | A | * | 6/1999 |
| JP | 2005-282456 | A | | 10/2005 |
| JP | 2008280942 | A | * | 11/2008 |
| KR | 101510397 | B1 | * | 4/2015 |

* cited by examiner

PUMP VOLUME CONTROL APPARATUS

TECHNICAL FIELD

The prevent invention relates to a pump volume control apparatus configured to control a pump volume of a variable displacement pump.

BACKGROUND ART

It is known to use a variable displacement pump rotatively driven by an engine as a pressure source of a hydraulic device mounted on a working machine such as a hydraulic shovel.

JP10-281073A discloses a pump volume control apparatus that includes: a swash plate for adjusting a pump volume of a variable displacement pump; a tilting piston for tilting the swash plate; and an electrically controlled regulator for adjusting a tilt driving pressure introduced into the tilting piston.

The electrically controlled regulator includes: a servo switching valve for adjusting the tilt driving pressure introduced into the tilting piston by a movement of a spool; a flow rate control piston for moving the spool via a flow rate control side lever; and a horsepower control piston for moving the spool via a horsepower control side lever.

During a normal operation, the flow rate of the pump is controlled by moving the spool via the flow rate control side lever through actuation of the flow rate control piston that moves in accordance with a control signal.

In a case where an abnormality occurs in a control system or a load of the pump increases and input power of the pump is going to exceed a drive force of an engine or the like, the flow rate of the pump is controlled by moving the spool via the horsepower control side lever through the actuation of the horsepower control piston that moves in accordance with a pump discharge pressure.

SUMMARY OF INVENTION

However, in the conventional pump volume control apparatus described above, the movements of the flow rate control piston and the horsepower control piston are transmitted to the spool of the servo switching valve via the flow rate control side lever and the horsepower control side lever, respectively. Thus, there is a possibility to reduce operational responsiveness of the servo switching valve due to a transmission delay caused by a rattle or friction of a link mechanism. Therefore, it is difficult to precisely control the pump volume.

It is an object of the present invention to provide a pump volume control apparatus capable of precisely controlling a pump volume of a variable displacement pump.

According to an aspect of the present invention, there is provided a pump volume control apparatus configured to change a pump volume of a pump in accordance with a tilt angle of a swash plate, the pump volume control apparatus including: a tilting piston configured to tilt the swash plate in a direction to reduce the pump volume as a tilt driving pressure becomes higher; a pump volume switching valve configured to adjust the tilt driving pressure in response to a movement of a spool; a flow rate control spring configured to bias the spool in accordance with the tilt angle of the swash plate; a horsepower control piston configured to move in accordance with a pump discharge pressure of the pump; and a horsepower control spring configured to bias the horsepower control piston in accordance with the tilt angle of the swash plate. In this case, the tilt driving pressure is adjusted by means of the movement of the spool in accordance with a force acting on the spool in response to a flow rate controlling signal pressure in a flow rate controlled state where a gap is formed between the horsepower control piston and the spool. The tilt driving pressure is also adjusted by means of the movement of the spool in accordance with a force acting on the horsepower control piston in response to the pump discharge pressure in a horsepower controlled state where the horsepower control piston is in contact with the spool.

DESCRIPTION OF EMBODIMENTS

Hereinafter, embodiments of the present invention will be described with reference to the accompanying drawings.

First, a first embodiment will be described.

Figure 1:
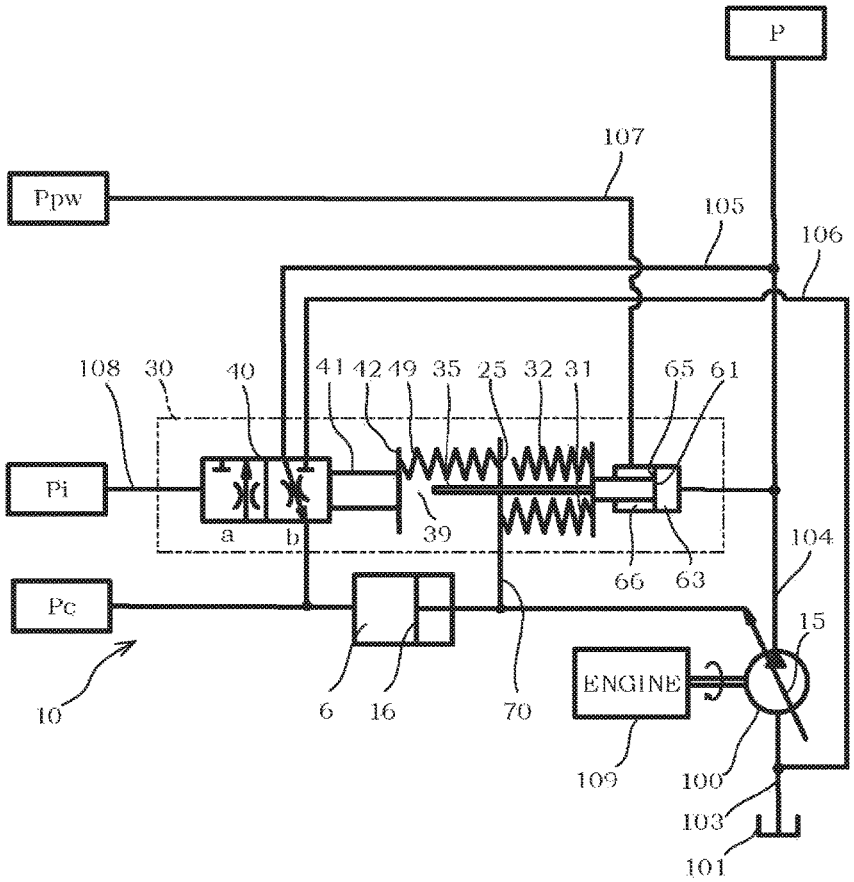
FIG. 1 is a hydraulic circuit diagram of a pump volume control apparatus according to a first embodiment of the present invention.

FIG. 1 is a hydraulic circuit diagram of a pump volume control apparatus according to the present embodiment. A pump volume control apparatus 10 is provided in a pressure source of a hydraulic device mounted in a hydraulic shovel. The pump volume control apparatus 10 controls a pump volume (pump displacement volume) of a variable displacement pump 100 (hereinafter, referred to as a "pump 100").

The pump 100 sucks hydraulic oil in a tank 101 through a suction passage 103, and discharges the hydraulic oil pressurized at a pump discharge pressure P to a discharge passage 104. The hydraulic oil fed through the discharge passage 104 is supplied to a hydraulic cylinder (not shown in the drawings) configured to drive a boom of the hydraulic shovel.

It should be noted that the hydraulic oil may be supplied to a hydraulic cylinder configured to drive not only the boom, but also an arm, a bucket or the like or to a hydraulic motor for driving travel, rotation or the like.

Further, although the hydraulic oil is used as working fluid in the present embodiment, water-soluble alternative liquid or the like may be used instead of the hydraulic oil, for example.

The pump 100 is a swash plate type piston pump driven by an engine 109. The pump 100 can change the pump volume in accordance with a tilt angle of a swash plate 15.

The pump volume control apparatus 10 includes a tilting piston 16 configured to change the tilt angle of the swash plate 15, and a regulator 30 configured to adjust a tilt driving pressure Pc introduced into the tilting piston 16.

A controller (not shown in the drawings) mounted on the hydraulic shovel adjusts a flow rate controlling signal pressure Pi as a pilot hydraulic pressure by receiving an operational signal based on an amount of lever operation by an operator and controlling actuation of an electromagnetic proportional control valve (not shown in the drawings) and the like provided in a hydraulic circuit in accordance with this operational signal. The flow rate controlling signal pressure Pi is introduced into the regulator 30 through a pump volume control signal passage 108. In this regard, although the flow rate controlling signal pressure Pi is adjusted by controlling the actuation of the electromagnetic proportional control valve in the present embodiment, the flow rate controlling signal pressure Pi may directly be adjusted by means of a pilot valve or the like by using the amount of lever operation by the operator as a pilot hydraulic pressure.

The pump discharge pressure P of the pump 100 is introduced into the regulator 30 as the other signal pressure. The regulator 30 is switched between a flow rate controlled state and a horsepower controlled state in accordance with the pump discharge pressure P. The regulator 30 is set to the flow rate controlled state in a case where the pump discharge pressure P is lower than a set value. The regulator 30 is set to the horsepower controlled state in a case where the pump discharge pressure P is the set value or higher.

In the flow rate controlled state, the regulator 30 adjusts the tilt driving pressure Pc introduced into the tilting piston 16 in accordance with the flow rate controlling signal pressure Pi.

In the horsepower controlled state, the regulator 30 adjusts the tilt driving pressure Pc introduced into the tilting piston 16 in accordance with the pump discharge pressure P.

An operation mode of the controller of the hydraulic shovel is switched between a high load mode and a low load mode. In the high load mode, a horsepower control signal pressure Ppw is adjusted so as to become high in order to increase a load of the pump 100 (will be described later). In the low load mode, the horsepower control signal pressure Ppw is adjusted so as to become low in order to reduce the load of the pump 100. The horsepower control signal pressure Ppw is introduced into the regulator 30 through a horsepower control signal passage 107. The controller switches the horsepower control signal pressure Ppw between a signal pressure for the high load mode and a signal pressure for the low load mode by controlling actuation of an electromagnetic valve (not shown in the drawings) provided in the hydraulic circuit in accordance with the operation mode.

Figure 2:
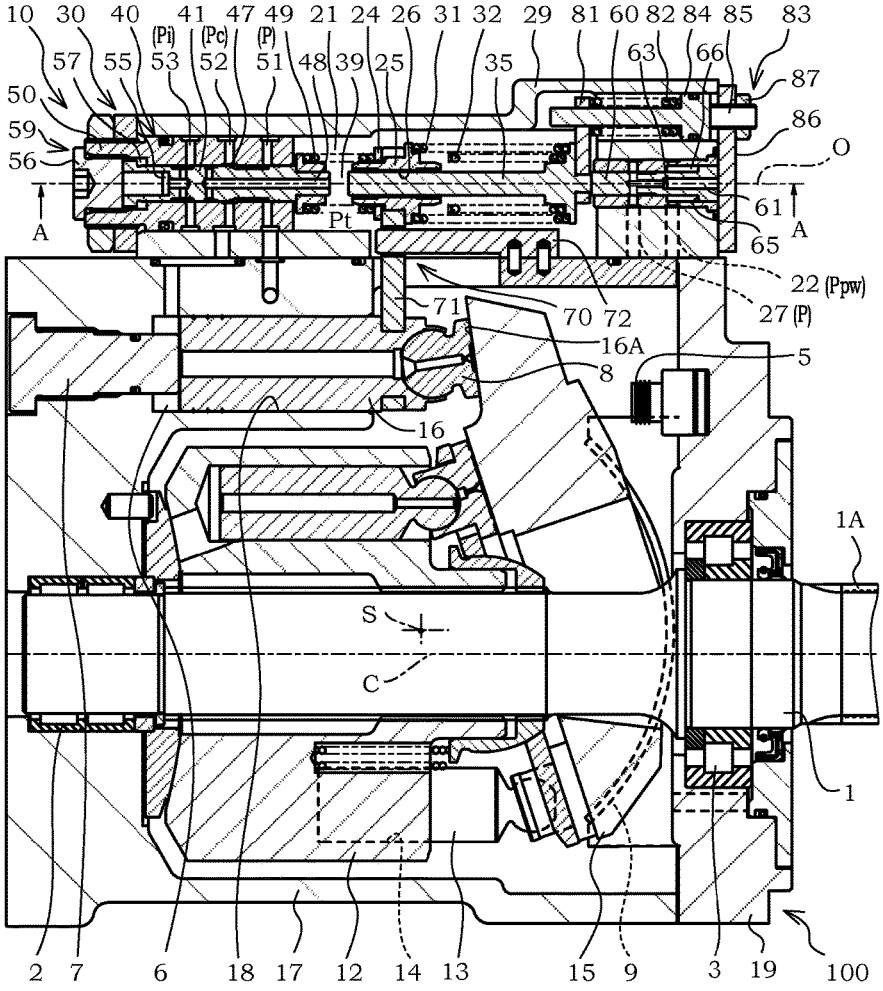
FIG. 2 is a cross-sectional view of a variable displacement pump and the pump volume control apparatus.

FIG. 2 is a cross-sectional view of the pump 100 and the pump volume control apparatus 10.

The pump 100 includes: a cylinder block 12 that is rotatively driven by an engine 109; pistons 13 that respectively reciprocate in a plurality of cylinders 14 provided in the cylinder block 12; and the swash plate 15 that is followed by each of the pistons 13.

A shaft 1 is fixed to the cylinder block 12. A tip part of the shaft 1 is rotatably supported on a pump housing 17 via a bearing 2, and a central part of the shaft 1 is rotatably supported on a pump cover 19 via a bearing 3. Power of the engine 109 is transmitted to a base end part 1A of the shaft 1.

The swash plate 15 is pivotably supported on the pump housing 17 via a tilt bearing 9. When the tilt angle of the swash plate 15 changes, stroke amounts of the pistons 13 with respect to the respective cylinders 14 change to change a pump volume.

A pivot center axis S of the swash plate 15 is arranged in an offset manner with respect to an axis of rotation C of the cylinder block 12. This causes the swash plate 15 to be biased in a direction to increase the tilt angle by means of a resultant force of reaction forces received from the respective pistons 13. Namely, an offset of the pivot center axis S with respect to the axis of rotation C acts as a tilt biasing mechanism that biases the swash plate 15 in a tilting direction.

It should be noted that a spring or a piston may be interposed between the swash plate 15 and the pump housing 17 as the tilt biasing mechanism.

The tilting piston 16 is slidably housed in a tilt cylinder 18 formed in the pump housing 17. The tilting piston 16 and the tilt cylinder 18 are arranged so as to extend in parallel to the axis of rotation C of the cylinder block 12 and a spool axis O (will be described later).

A tip of the tilting piston 16 slides in contact with a projecting part 16A of the swash plate 15 via a shoe 8. A tilt driving pressure chamber 6 is defined between the tilting piston 16 and the tilt cylinder 18. The tilting piston 16 moves to the right direction in FIG. 1 as the tilt driving pressure Pc introduced from the regulator 30 to the tilt driving pressure chamber 6 increases, and tilts the swash plate 15 in a direction to reduce the tilt angle via the shoe 8.

A plug 7 projecting into the tilt cylinder 18 is threadably engaged with the pump housing 17. The plug 7 defines the maximum tilt angle of the swash plate 15 by bringing a tip surface thereof into contact with a base end of the tilting piston 16.

Figure 3:
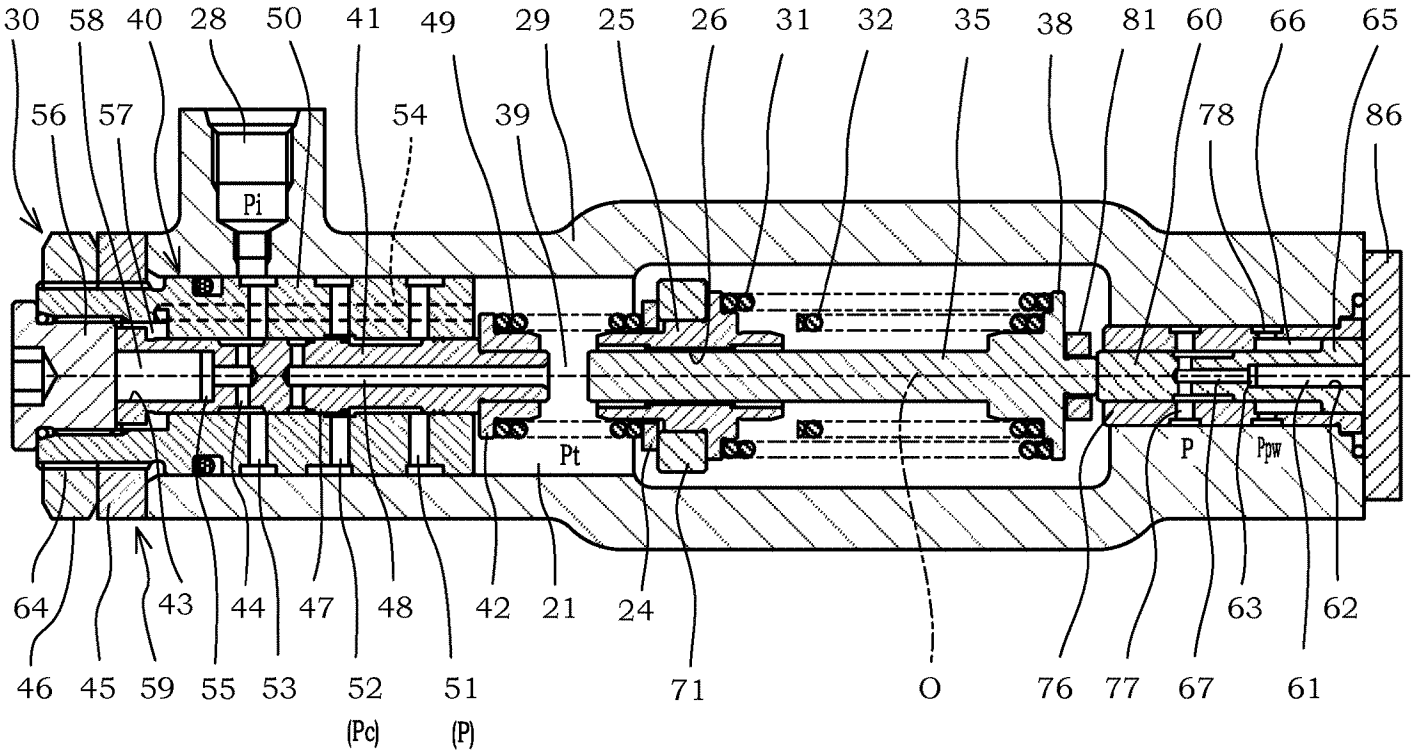
FIG. 3 is a cross-sectional view showing a cross section taken along III-III of FIG. 2.

As shown in FIGS. 2 and 3, the regulator 30 includes a regulator housing 29 to be attached to the pump housing 17.

A pump volume switching valve 40, a flow rate control spring 49, a horsepower control piston 60, horsepower control springs 31, 32, a rod 35 and the like are housed side by side in a direction of the spool axis O of a spool 41 of the pump volume switching valve 40 in the regulator housing 29.

The pump volume switching valve 40 includes a tubular sleeve 50 and the spool 41 housed into the sleeve 50 slidably in the direction of the spool axis O.

A plug 56 is threadably attached to a base end part of the sleeve 50. The spool 41 is biased in a direction toward the plug 56 (in the left direction in FIG. 3) by the flow rate control spring 49. The plug 56 regulates a stroke of the spool 41 by bringing a tip surface thereof into contact with a base end surface of the spool 41.

A shaft hole 43 is formed in the spool 41. The shaft hole 43 opens on a base end of the spool 41 and extends in an axial direction. A pin 58 is slidably housed in the shaft hole 43. A signal pressure chamber 55 is defined between the shaft hole 43 of the spool 41 and a tip of the pin 58. The spool 41 and the pin 58 are regulated to move in the left direction in FIGS. 2 and 3 by bringing the base ends of the spool 41 and the pin 58 into contact with the plug 56.

The flow rate controlling signal pressure Pi according to the amount of lever operation by the operator is introduced into the signal pressure chamber 55 through the pump volume control signal passage 108 (see FIG. 1).

The pump volume control signal passage 108 is configured by a port 28 of the regulator housing 29, a signal pressure port 53 of the sleeve 50 and a back pressure port 44 of the spool 41. The flow rate controlling signal pressure Pi is introduced into the port 28 of the regulator housing 29 through a pipe (not shown in the drawings) connected to this port 28.

A back pressure chamber 57 is defined between the base end parts of the sleeve 50 and the spool 41 and the plug 56. The back pressure chamber 57 communicates with a center chamber 21 in the regulator housing 29 of the pump 100 through the back pressure port 54. The center chamber 21 communicates with the tank 101 (see FIG. 1) through a drain passage (not shown in the drawings). By the communication of the back pressure chamber 57 with the tank 101, the spool 41 can smoothly move.

A tilt driving pressure port 52 and a source pressure port 51 are formed in the sleeve 50. The tilt driving pressure port 52 communicates with the tilt driving pressure chamber 6 (see FIG. 2) of the tilting piston 16. The source pressure port 51 communicates with a source pressure passage 105 (see FIG. 1). The pump discharge pressure P is introduced as a source pressure to the source pressure port 51 through the source pressure passage 105 (see FIG. 1).

A tank port 48 is formed in the spool 41. The tank port 48 communicates with the tank 101 through the center chamber 21 in the regulator housing 29.

An annularly projecting land part 47 is formed on an outer periphery of the spool 41. When the land part 47 moves in the direction of the spool axis O, the source pressure port 51 or the tank port 48 selectively communicates with the tilt driving pressure port 52. In this manner, the tilt driving pressure Pc generated in the tilt driving pressure port 52 is adjusted.

In a state where the spool 41 is biased by the flow rate control spring 49 and moved in the left direction as shown in FIGS. 2 and 3, the source pressure port 51 communicates with the tilt driving pressure port 52 and the tilt driving pressure Pc in the tilt driving pressure port 52 is increased by the pump discharge pressure P introduced from the source pressure passage 105. The tilting piston 16 tilts the swash plate 15 in the direction to reduce the tilt angle as the tilt driving pressure Pc increases. In this manner, the pump volume is reduced.

When the spool 41 is moved in the right direction in FIGS. 2 and 3 with an increase in the flow rate controlling signal pressure Pi, the tank port 48 communicates with the tilt driving pressure port 52, and the tilt driving pressure Pc introduced into the tilt driving pressure port 52 is reduced by a tank pressure Pt introduced into the tank port 48 through the tank passage 106. The tilting piston 16 tilts the swash plate 15 in the direction to increase the tilt angle as the tilt driving pressure Pc decreases. In this manner, the pump volume is increased.

The sleeve 50 is inserted into the regulator housing 29 movably in the direction of the spool axis O. A position of the sleeve 50 can be adjusted in the direction of the spool axis O.

A pump volume switching adjuster mechanism 59 includes: a screw part 64 formed on an outer periphery of the base end part of the sleeve 50; a cover 45 threadably engaged with the screw part 64; and a locknut 46. The cover 45 is fixed so as to be in contact with an opening end of the regulator housing 29.

The pump volume switching adjuster mechanism 59 moves the sleeve 50 in the direction of the spool axis O with respect to the pump housing 17 by adjusting the threadably engaged position of the sleeve 50 with the cover 45. This causes a spring load of the flow rate control spring 49 to change, and switch timing of the spool 41 to the positions a and b (FIG. 1) in accordance with the flow rate controlling signal pressure Pi is adjusted.

It should be noted that there is no limitation to this configuration, and the regulator housing 29 and the sleeve 50 may be integrally formed.

The spool 41 includes a tip part that projects from an opening end of the sleeve 50, and a spool-side spring bearing 42 is mounted on the tip part. One end of the coil-shaped flow rate control spring 49 is seated on the spool-side spring bearing 42.

The rod 35 is provided in the regulator housing 29. A tubular retainer 25 is slidably mounted on an outer peripheral surface of the rod 35. A shaft hole 26 is formed in the retainer 25 so as to extend on the spool axis O. The outer peripheral surface of the cylindrical rod 35 is slidably inserted into the shaft hole 26 of the retainer 25.

A retainer-side spring bearing 24 is mounted on the retainer 25. One end of the flow rate control spring 49 is seated on the retainer-side spring bearing 24. The flow rate control spring 49 is interposed in a compressed manner between the spool-side spring bearing 42 and the retainer-side spring bearing 24.

A link 71 is fixed to the retainer 25. The link 71 is a member that couples the retainer 25 to the tilting piston 16, and is provided from the inside of the regulator housing 29 to the inside of the pump housing 17. One end of the link 71 is fitted and joined to an outer periphery of the retainer 25. The other end of the link 71 is fitted and joined to an outer peripheral groove of the tilting piston 16.

The link 71 and the tilting piston 16 constitute a retainer moving mechanism 70 configured to move the retainer 25 in the direction of the spool axis O in association with a tilting movement of the swash plate 15.

In this regard, in addition to the configuration described above, the retainer moving mechanism 70 may be structured so as to interlock the retainer 25 with the swash plate 15 without via the tilting piston 16.

As shown in FIG. 2, a guide 72 configured to slidably support the link 71 is provided in the pump housing 17. A base end part of the rod-shaped guide 72 is fixed to the pump housing 17, and a tip part of the guide 72 is slidably inserted into a hole of the link 71. The guide 72 is formed so as to extend in parallel to the spool axis O.

Since the link 71 is slidably supported on the guide 72, deviations of the retainer 25, the flow rate control spring 49 and the horsepower control springs 31, 32 in a direction perpendicular to the spool axis O can be suppressed.

The regulator 30 also has a function to carry out a horsepower control for suppressing the load of the pump 100 by moving the spool 41 in the direction of the spool axis O in accordance with the pump discharge pressure P of the pump 100 to adjust the tilt driving pressure Pc.

As shown in FIGS. 2 and 3, the regulator 30 includes the horsepower control piston 60, the horsepower control springs 31, 32, and the rod 35. The horsepower control piston 60 moves in the direction of the spool axis O in accordance with the pump discharge pressure P. Each of the horsepower control springs 31, 32 biases the horsepower control piston 60 in the direction of the spool axis O in accordance with the tilt angle of the swash plate 15. The rod 35 is provided between the horsepower control piston 60 and the spool 41.

The rod 35 is arranged so that a tip thereof faces a tip of the spool 41 with a gap 39 formed therebetween.

An annularly projecting jaw part 38 is formed on a base end part of the rod 35. The horsepower control springs 31, 32 are interposed between the jaw part 38 and the retainer 25.

The horsepower control springs 31, 32 are respectively formed into coil shapes having different winding diameters of wire materials. The horsepower control spring 32 having a smaller winding diameter is arranged in the horsepower control spring 31 having a larger winding diameter. As shown in FIG. 2, in a state where the tilt angle of the swash plate 15 becomes the maximum, the horsepower control spring 31 having the larger winding diameter is compressed between the retainer 25 and the rod 35, and one end of the horsepower control spring 32 having the smaller winding diameter is separated from the retainer 25. When the tilt angle of the swash plate 15 becomes smaller than a predetermined value, the horsepower control spring 32 is compressed by respectively bringing both ends thereof into contact with the retainer 25 and the rod 35. In this manner, a spring force of each of the horsepower control springs 31, 32 applied to the horsepower control piston 60 is increased in a stepwise manner.

It should be noted that there is no limitation to this configuration, and only one horsepower control spring or three or more horsepower control springs may be provided between the retainer 25 and the rod 35.

As shown in FIG. 2, an adjuster spring 82 and a horsepower controlling adjuster mechanism 83 are provided in the regulator housing 29. The adjuster spring 82 and the horsepower controlling adjuster mechanism 83 are configured to adjust a spring load of the horsepower control spring 31.

The coil-shaped adjuster spring 82 is interposed in a compressed manner between an adjuster link 81 coupled to the rod 35 and an adjuster rod 84 slidably inserted into the adjuster link 81.

An adjuster screw 85 is threadably engaged with a cover 86 for closing one end of the regulator housing 29. The adjuster screw 85 is in contact with a base end of the adjuster rod 84. A locknut 87 is fastened to the adjuster screw 85.

The adjuster spring 82, the adjuster rod 84 and the adjuster screw 85 are coaxially arranged.

It should be noted that the adjuster rod 84 and the adjuster screw 85 may be integrally formed.

The rod 35 is moved in the direction of the spool axis O to adjust the spring load of the horsepower control spring 31 by changing a threadably engaged position of the adjuster screw 85 with respect to the cover 86 to adjust a spring load of the adjuster spring 82.

As shown in FIGS. 2 and 3, a tubular horsepower control cylinder 76 is provided in the regulator housing 29. The horsepower control piston 60 is slidably inserted into the horsepower control cylinder 76.

It should be noted that there is no limitation to this configuration, and the regulator housing 29 and the horsepower control cylinder 76 may be integrally formed.

A tip surface of the horsepower control piston 60, which projects from the horsepower control cylinder 76, is in contact with a base end surface of the rod 35.

It should be noted that there is no limitation to this configuration, and the rod 35 may be formed integrally with the horsepower control piston 60.

A shaft hole 62 is formed in the horsepower control piston 60, and a pin 61 is inserted into the shaft hole 62. A first pressure chamber 63 is defined by a tip surface of the pin 61 in the shaft hole 62. The first pressure chamber 63 communicates with the discharge passage 104 (see FIG. 1) through a through hole 67 of the horsepower control piston 60, a through hole 77 of the horsepower control cylinder 76 and a through hole 27 (see FIG. 2) of the regulator housing 29. The pump discharge pressure P is introduced into the first pressure chamber 63 through the discharge passage 104.

As the pump discharge pressure P increases, the horsepower control piston 60 is moved in the left direction in FIGS. 2 and 3 to increase the spring forces of the horsepower control springs 31, 32.

An annular stepped part 65 is formed on an outer periphery of the horsepower control piston 60. A second pressure chamber 66 is defined between the stepped part 65 and the horsepower control cylinder 76.

The horsepower control signal pressure Ppw for switching the operation mode in response to a command of the controller as described above is introduced into the second pressure chamber 66 through the horsepower control signal passage 107 (see FIG. 1). The horsepower control signal passage 107 is formed by a through hole 22 of the regulator housing 29 and a through hole 78 of the horsepower control cylinder 76.

When the horsepower control signal pressure Ppw increases, the horsepower control piston 60 is moved in the right direction in FIGS. 2 and 3 to reduce the spring forces of the horsepower control springs 31, 32.

The spool 41, the retainer 25, the rod 35 and the horsepower control piston 60 are arranged side by side on the spool axis O. This causes forces from the spool 41 and the horsepower control piston 60 to act on the same axis on both ends of the rod 35.

It should be noted, in addition to the configuration described above, a mechanism for guiding the rod 35 along the regulator housing 29 may be provided and the rod 35 may be arranged in an offset manner from the spool axis O.

Next, an operation of the pump volume control apparatus 10 is described.

An operation in the flow rate controlled state will be described with reference to FIGS. 2 to 5. In the flow rate controlled state, the gap 39 is present between the spool 41 and the rod 35, and the tilt driving pressure Pc introduced into the tilt driving pressure chamber 6 is adjusted by moving the spool 41 so as to balance a force acting on the spool 41 due to the flow rate controlling signal pressure Pi and the spring force of the flow rate control spring 49.

FIGS. 2 and 3 show a stopped state of the pump 100 where the operation of the engine 109 of the hydraulic shovel is stopped. Since the flow rate controlling signal pressure Pi is low in the stopped state, the spool 41 is moved in the left direction by the spring force of the flow rate control spring 49. This causes the source pressure port 51 to communicate with the tilt driving pressure port 52. At this time, since the operation of the pump 100 is stopped, the pump discharge pressure P is substantially zero. Thus, the tilting piston 16 is held in contact with the plug 7 and the swash plate 15 is held at the maximum tilt angle position.

Figure 4:
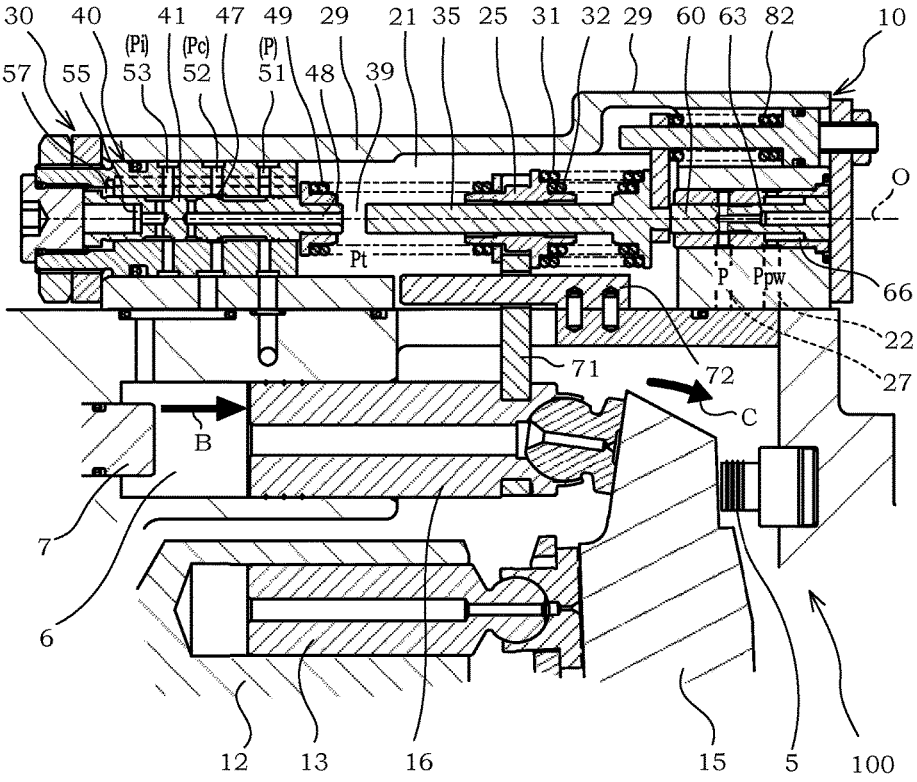
FIG. 4 is a cross-sectional view showing an operation of the pump volume control apparatus in a standby state.

FIG. 4 shows a standby state of the pump 100 where the engine 109 of the hydraulic shovel is operated to actuate the pump 100 and the hydraulic cylinder configured to drive the boom is stopped. Since the flow rate controlling signal pressure Pi introduced into the signal pressure chamber 55 is adjusted so as to become low in the standby state, the source pressure port 51 remain to communicate with the tilt driving pressure port 52. Since the pump discharge pressure P introduced from the source pressure passage 105 increases as the pump 100 is operated, the tilt driving pressure Pc introduced into the tilt driving pressure chamber 6 from the tilt driving pressure port 52 increases. As a result, the tilting piston 16 that receives the tilt driving pressure Pc is moved in the right direction as indicated by an arrow B, the swash plate 15 tilts in a direction indicated by an arrow C, and the swash plate 15 is held at the minimum tilt angle position where the swash plate 15 is in contact with a stopper 5.

Figure 5:
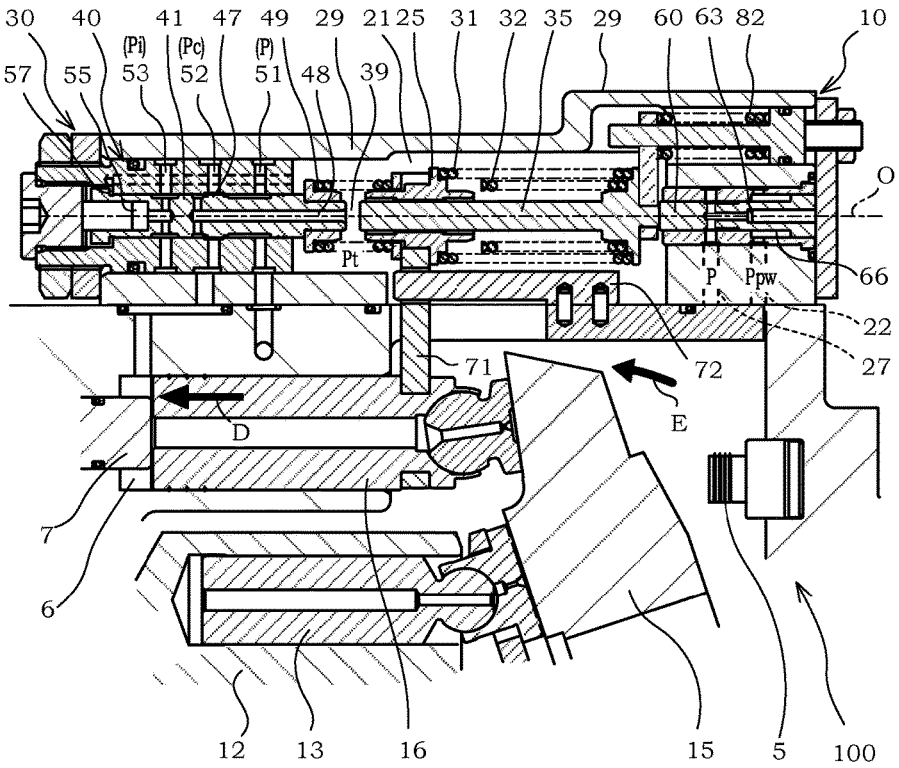
FIG. 5 is a cross-sectional view showing an operation of the pump volume control apparatus in a flow rate controlled state.

FIG. 5 shows a flow rate controlled state of the pump 100 where the hydraulic cylinder is extended and contracted by the hydraulic oil discharged from the pump 100. In the flow rate controlled state, the flow rate controlling signal pressure Pi introduced into the signal pressure chamber 55 on the basis of the lever operation by the operator increases. When the flow rate controlling signal pressure Pi increases, the spool 41 is moved in the right direction against the spring force of the flow rate control spring 49, whereby the tank port 48 communicates with the tilt driving pressure port 52. This reduces the tilt driving pressure Pc introduced into the tilt driving pressure chamber 6 from the tilt driving pressure port 52. As a result, the tilting piston 16 that receives the tilt driving pressure Pc is moved in the left direction as indicated by an arrow D in FIG. 5, whereby the swash plate 15 tilts in a direction indicated by an arrow E and the tilting piston 16 is moved toward the maximum tilt angle position to come into contact with the plug 7. At this time, since the link 71 coupled to the tilting piston 16 is moved in the left direction in FIG. 5 and the retainer 25 is also moved in the left direction, the flow rate control spring 49 is compressed. By moving the retainer 25 and the tilting piston 16 so as to balance the spring force of the flow rate control spring 49 with the flow rate controlling signal pressure Pi received by the spool 41, the swash plate 15 tilts and the pump volume is controlled in accordance with the tilt angle of the swash plate 15.

Figure 7:
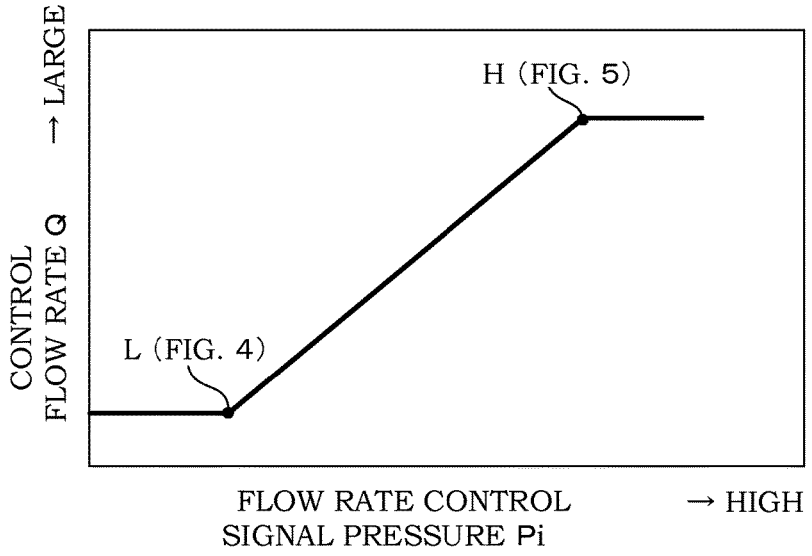
FIG. 7 is a characteristic diagram showing a relationship of a flow rate controlling signal pressure and a controlled flow rate.

FIG. 7 is a characteristic diagram showing a relationship between the flow rate controlling signal pressure Pi and a controlled flow rate Q supplied from the pump 100 to the hydraulic cylinder (not shown in the drawings) in the flow rate controlled state. In the flow rate controlled state, a positive flow rate control is carried out to gradually increase the controlled flow rate Q as the flow rate controlling signal pressure Pi increases. It should be noted that the standby state where the swash plate 15 is in contact with the stopper 5 as shown in FIG. 4 corresponds to a point L where the flow rate controlling signal pressure Pi becomes the minimum set value in the characteristic diagram of FIG. 7. The flow rate controlled state where the tilting piston 16 is in contact with the plug 7 to become the maximum tilt angle position as shown in FIG. 5 corresponds to a point H where the flow rate controlling signal pressure Pi increases the maximum set value in the characteristic diagram of FIG. 7.

The pump volume control apparatus 10 adjusts the controlled flow rate Q of the hydraulic oil supplied from the pump 100 to the hydraulic cylinder so as to increase the controlled flow rate Q as the flow rate controlling signal pressure Pi becomes higher as shown in FIG. 7 in the flow rate controlled state where the gap 39 is present between the spool 41 and the rod 35.

Figure 6:
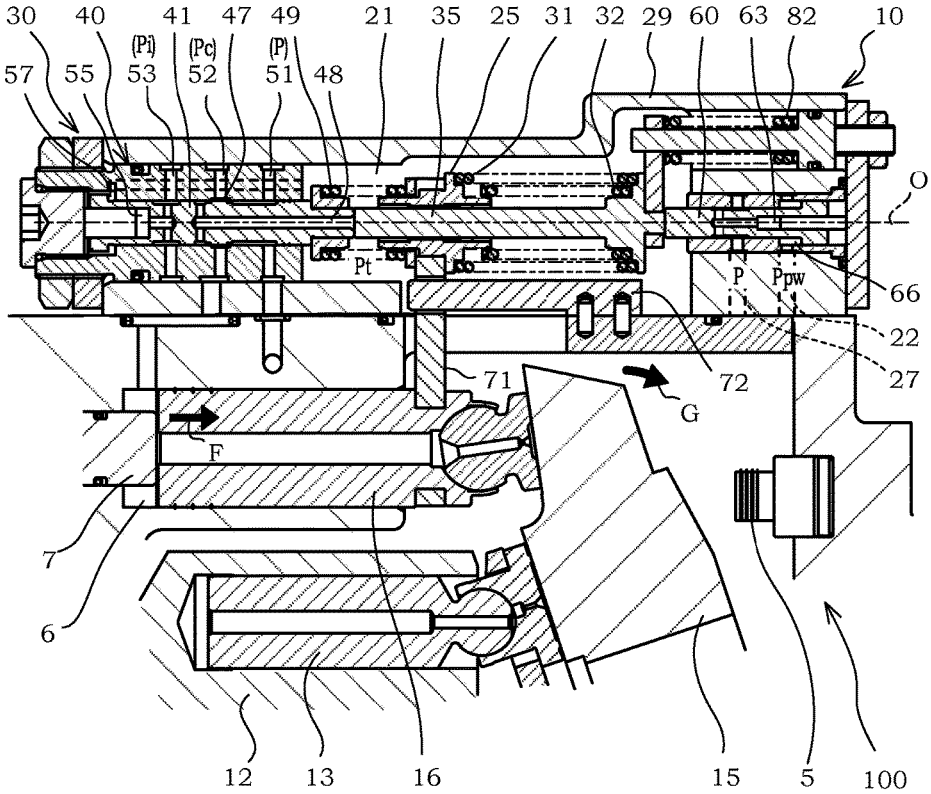
FIG. 6 is a cross-sectional view showing an operation of the pump volume control apparatus in a horsepower controlled state.

When the pump discharge pressure P (load) of the pump 100 becomes higher than the set value, the horsepower control piston 60 that receives the pump discharge pressure P in the first pressure chamber 63 is moved in a direction to approach the spool 41 as shown in FIG. 6. FIG. 6 shows the horsepower controlled state where the tip of the rod 35 is in contact with the spool 41 due to a movement of the horsepower control piston 60.

In the horsepower controlled state, the horsepower control piston 60, the rod 35 and the spool 41 are integrally moved so that the flow rate controlling signal pressure Pi, the signal pressure based on the pump discharge pressure P, the spring force of the flow rate control spring 49, the spring forces of the horsepower control springs 31, 32 and the like are balanced.

When the pump discharge pressure P further increases from the state shown in FIG. 6, the horsepower control piston 60 pushes the spool 41 via the rod 35, whereby the spool 41 is moved in the left direction and switching is made from the state where the tank port 48 communicates with the tilt driving pressure port 52 to the state where the source pressure port 51 communicate with the tilt driving pressure port 52. This causes the tilt driving pressure Pc to increase, whereby the tilting piston 16 is moved in the right direction indicated by an arrow F away from the plug 7 to reduce the tilt angle. At this time, since the link 71 coupled to the tilting piston 16 is moved in the right direction in FIG. 6 and the retainer 25 is also moved in the right direction, the flow rate control spring 49 is extended and the horsepower control springs 31, 32 are compressed. By forcibly moving the spool 41, the tilting piston 16 is moved in the direction of the arrow F, and the swash plate 15 is moved in the direction of an arrow G to reduce the pump volume.

Figure 8:
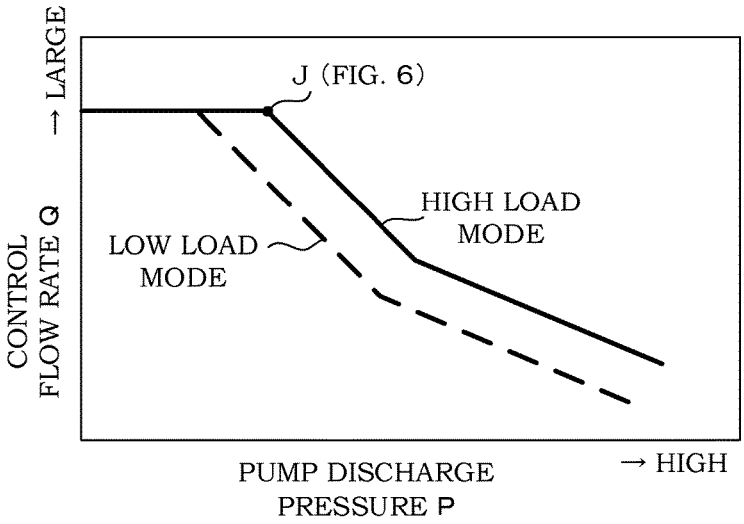
FIG. 8 is a characteristic diagram showing a relationship of a pump discharge pressure and the controlled flow rate.

FIG. 8 is a characteristic diagram showing a relationship between the pump discharge pressure P and the controlled flow rate Q supplied from the pump 100 to the hydraulic cylinder in the horsepower controlled state. In the horsepower controlled state, an equal horsepower characteristic in which the controlled flow rate Q decreases as the pump discharge pressure P increases (a characteristic in which the product of the pump discharge pressure P and the controlled flow rate Q is substantially constant) is obtained. It should be noted that the state shown in FIG. 6 corresponds to a point J where the controlled flow rate Q becomes the maximum value in the characteristic diagram of FIG. 8.

It should be noted that the horsepower control signal pressure Ppw introduced into the horsepower control piston 60 on the basis of a command of the controller is adjusted so as to become high in the high load mode, while the horsepower control signal pressure Ppw is adjusted so as to become low in the low load mode. When the horsepower control signal pressure Ppw introduced into the second pressure chamber 66 is adjusted so as to become low in the low load mode, the horsepower control piston 60 is moved in the left direction in FIG. 6 together with the rod 35 and the spool 41 to increase the tilt driving pressure Pc. In this manner, the pump volume decreases to reduce the load of the pump 100.

In FIG. 8, a solid line represents a characteristic in the high load mode and a broken line represents a characteristic in the low load mode. In the low load mode, the pump discharge pressure P becomes lower than that in the high load mode, and the controlled flow rate Q decreases to reduce the load (power) of the pump 100.

According to the embodiment described above, the following effects are achieved.

The regulator 30 of the pump volume control apparatus 10 includes: the pump volume switching valve 40 configured to adjust the tilt driving pressure Pc by moving the spool 41 in the direction of the spool axis O; the flow rate control spring 49 configured to bias the spool 41 in the direction of the spool axis O in accordance with the tilt angle of the swash plate 15; the horsepower control piston 60 that is moved in the direction of the spool axis O in accordance with the pump discharge pressure P; the horsepower control springs 31, 32 configured to bias the horsepower control piston 60 in the direction of the spool axis O in accordance with the tilt angle of the swash plate 15; and the gap 39 provided between the horsepower control piston 60 and the spool 41.

In the flow rate controlled state where the gap 39 is formed between the horsepower control piston 60 and the spool 41, the spool 41 is moved in accordance with the force acting on the spool 41 due to the flow rate controlling signal pressure Pi, whereby the tilt driving pressure Pc is adjusted. This makes it possible to control the controlled flow rate Q of the hydraulic oil supplied to the hydraulic cylinder in accordance with the amount of lever operation by the operator.

In the horsepower controlled state where the gap 39 is not formed between the horsepower control piston 60 and the spool 41 and the spool 41 is in contact with the horsepower control piston 60, the spool 41 is moved in accordance with the force acting on the horsepower control piston 60 due to the pump discharge pressure P, whereby the tilt driving pressure Pc is adjusted. Therefore, it is possible to prevent the load of the pump 100 from becoming excessive and to prevent an engine stall or the like in which the operation of the engine 109 is stopped from occurring.

In the horsepower controlled state, the spool 41 is moved by being pushed by means of the horsepower control piston 60. Since the horsepower control piston 60 and the spool 41 have no rotary joint part or the like, there is no transmission delay caused by a rattle or friction. Therefore, a control error of the pump volume can be reduced by improving operational responsiveness of the pump volume switching valve 40.

Further, since the rod 35 is provided between the spool 41 and the horsepower control piston 60 in the regulator 30, the spool 41 is moved by being pushed by means of the horsepower control piston 60 via the rod 35 in the horsepower controlled state.

Moreover, the spool 41, the rod 35 and the horsepower control piston 60 are coaxially arranged in the regulator 30. This causes the spool 41, the rod 35 and the horsepower control piston 60 to be moved side by side on the same axis. Therefore, the spool 41, the rod 35 and the horsepower control piston 60 are smoothly moved and operational responsiveness of the pump volume switching valve 40 can be improved.

Further, the spool 41 is moved in the direction to reduce the tilt driving pressure Pc as the flow rate controlling signal pressure Pi becomes higher in the flow rate controlled state. The spool 41 is also moved in the direction to increase the tilt driving pressure Pc as the pump discharge pressure P becomes higher in the horsepower controlled state.

In this manner, the positive flow rate control to increase the pump volume as the flow rate controlling signal pressure Pi becomes higher is carried out in the flow rate controlled state. On the other hand, the horsepower control to reduce the pump volume as the pump discharge pressure P becomes higher is carried out in the horsepower controlled state.

Moreover, the regulator 30 includes: the retainer 25 provided movably in the axial direction with respect to the rod 35; and the retainer moving mechanism 70 configured to move the retainer 25 by the tilting movement of the swash plate 15. The horsepower control springs 31, 32 are interposed between the retainer 25 and the rod 35, while the flow rate control spring 49 is interposed between the spool 41 and the retainer 25.

In this manner, the retainer 25 is moved in association with the tilting movement of the swash plate 15 to cause the horsepower control springs 31, 32 to extend and contract via the retainer 25, and to cause the flow rate control spring 49 to extend and contract. Since the rod 35 is arranged with the gap 39 formed between the rod 35 and the spool 41 in the flow rate controlled state in this manner, the tilt driving pressure Pc is adjusted so as to balance the spring force of the flow rate control spring 49 with the force received by the spool 41 due to the flow rate controlling signal pressure Pi, and the positive flow rate control to increase the pump volume as the flow rate controlling signal pressure Pi increases is carried out. On the other hand, in the horsepower controlled state, the rod 35 is in contact with the spool 41, and the tilt driving pressure Pc is adjusted by forcibly pushing the spool 41.

Further, the retainer moving mechanism 70 includes the link 71 coupling the tilting piston 16 to the retainer 25. Since the movement of the tilting piston 16 is transmitted to the retainer 25 via the link 71 in this manner, the structure of the retainer moving mechanism 70 can be simplified.

Moreover, since the link 71 fixes a positional relationship between the tilting piston 16 and the retainer 25 and there is no need to provide a rotary joint part or the like, the occurrence of a transmission delay due to a rattle or friction can be prevented. Therefore, a control error of the pump volume can be reduced by improving operational responsiveness of the pump volume switching valve 40.

Further, the retainer moving mechanism 70 includes the guide 72 configured to slidably support the link 71. Since the link 71 is slidably supported on the guide 72 in this manner, the link 71 and the retainer 25 are moved along the guide 72, and deviations of the retainer 25 and the rod 35 in the direction perpendicular to the spool axis O can be suppressed.

Moreover, the regulator 30 includes: the adjuster spring 82 configured to bias the rod 35 in the direction to compress the horsepower control springs 31, 32; and the horsepower controlling adjuster mechanism 83 configured to adjust the spring force of the adjuster spring 82.

Since the spring force of the adjuster spring 82 is adjusted by the horsepower controlling adjuster mechanism 83, the spring forces of the horsepower control springs 31, 32 are adjusted via the rod 35 to adjust the load of the variable displacement pump 100.

Further, the regulator 30 includes the first pressure chamber 63 that is defined by the horsepower control piston 60 and into which the pump discharge pressure P is introduced; and the second pressure chamber 66 that is defined by the horsepower control piston 60 and into which the horsepower control signal pressure Ppw is introduced. In the horsepower controlled state, the horsepower control piston 60 moves the spool 41 in the direction to reduce the tilt driving pressure Pc as the horsepower control signal pressure Ppw increases.

The horsepower control piston 60 is moved to a position where the force received by the horsepower control piston 60 from the pump discharge pressure P and the horsepower control signal pressure Ppw is balanced with the spring forces of the horsepower control springs 31, 32. In this manner, the load of the variable displacement pump 100 is adjusted in accordance with the horsepower control signal pressure Ppw.

Moreover, the pump volume switching valve 40 includes: the sleeve 50 into which the spool 41 is slidably inserted; and the pump volume switching adjuster mechanism 59 configured to adjust the position of the sleeve 50 in the direction of the spool axis O.

Since the spring load of the flow rate control spring 49 can be changed by adjusting the position of the sleeve 50 by means of the pump volume switching adjuster mechanism 59, timings at which the tilt driving pressure Pc is increased and reduced in accordance with the flow rate controlling signal pressure Pi can be adjusted.

Next, a second embodiment will be described.

Figure 9:
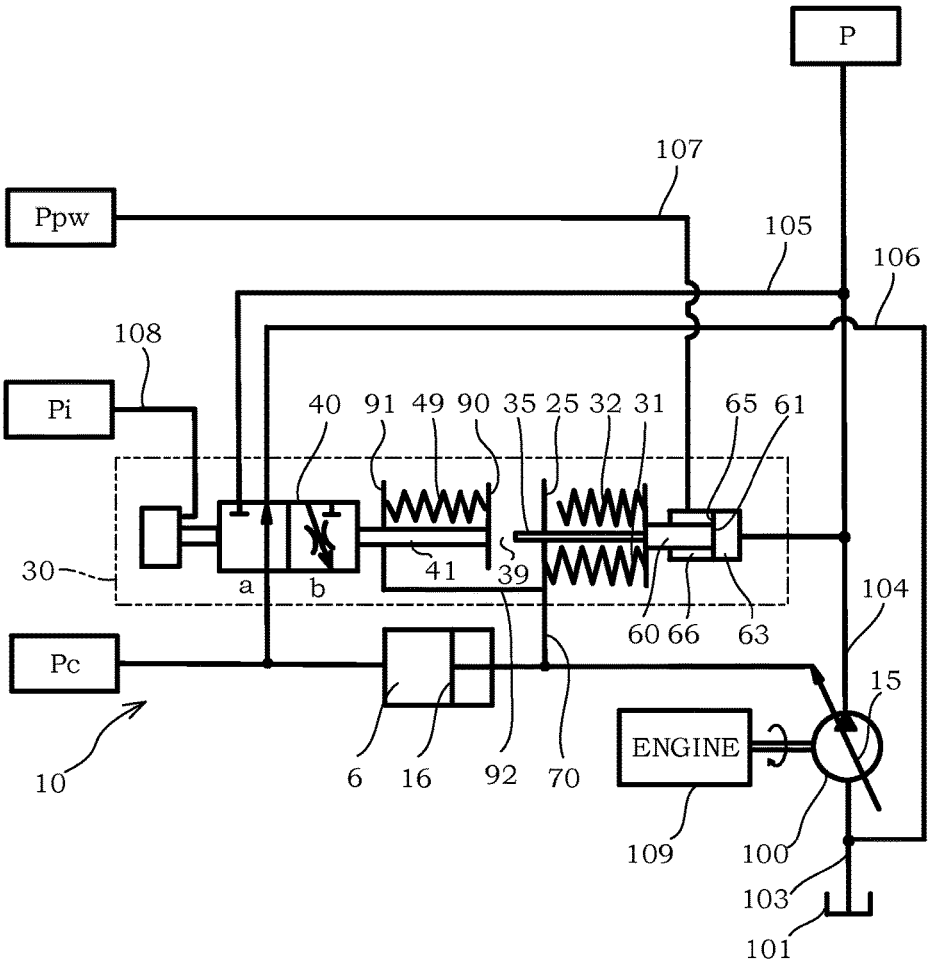
FIG. 9 is a hydraulic circuit diagram of a pump volume control apparatus according to a second embodiment of the present invention.

FIG. 9 is a hydraulic circuit diagram of a pump volume control apparatus according to the present embodiment. The following description is centered on points different from those of the first embodiment. The same configuration as that in the pump volume control apparatus 10 according to the first embodiment are denoted by the same reference numerals, and the explanation thereof will be omitted.

The pump volume control apparatus 10 according to the first embodiment is configured so as to carry out the positive flow rate control to increase the controlled flow rate Q in proportion to an increase in the flow rate controlling signal pressure Pi in the flow rate controlled state. Contrary to this, the pump volume control apparatus 10 according to the present embodiment is configured so as to carry out a negative flow rate control to reduce the controlled flow rate Q in proportion to an increase in the flow rate controlling signal pressure Pi in a flow rate controlled state.

A regulator 30 includes: a spool-side spring bearing 90 coupled to a spool 41; and a retainer-side spring bearing 91 coupled to a retainer 25. The retainer-side spring bearing 91 is arranged on a side closer to a sleeve 50 (FIG. 3) than the spool-side spring bearing 90 via an extension member 92. A flow rate control spring 49 is interposed in a compressed manner between the retainer-side spring bearing 91 and the spool-side spring bearing 90, and the rate control spring 49 biases the spool 41 in a direction to reduce a tilt driving pressure Pc.

A flow rate controlling signal pressure Pi introduced into the spool 41 acts to move the spool 41 in a direction to increase the tilt driving pressure Pc against the flow rate control spring 49.

In a state where the flow rate controlling signal pressure Pi is low, the spool 41 is moved in a direction to reduce the tilt driving pressure Pc by means of a spring force of the flow rate control spring 49. A tilting piston 16 that receives this tilt driving pressure Pc holds a swash plate 15 at the maximum tilt angle, and a pump volume is thereby maximized.

When the flow rate controlling signal pressure Pi increases, the spool 41 is moved in the direction to increase the tilt driving pressure Pc against the flow rate control spring 49. The tilting piston 16 that receives this tilt driving pressure Pc tilts the swash plate 15 in a direction to reduce a tilt angle thereof, and the pump volume is thereby reduced.

Figure 10:
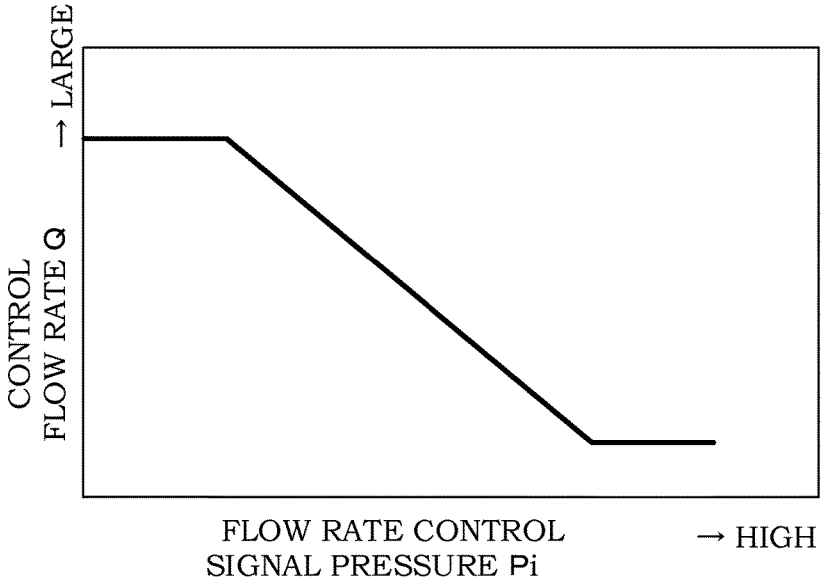
FIG. 10 is a characteristic diagram showing a relationship of a flow rate controlling signal pressure and a controlled flow rate.

FIG. 10 is a characteristic diagram showing a relationship between the flow rate controlling signal pressure Pi and a controlled flow rate Q supplied from a pump 100 to a hydraulic cylinder in the flow rate controlled state where the spool 41 is moved with a gap 39 formed between the spool 41 and a rod 35. At this time, the negative flow rate control to gradually reduce the controlled flow rate Q is carried out as the flow rate controlling signal pressure Pi increases from a small value.

On the other hand, when a driving load (a pump discharge pressure P) of the pump 100 becomes higher than the set value, a horsepower control piston 60 that receives the pump discharge pressure P is moved in a first pressure chamber 63. When the rod 35 comes into contact with the spool 41, the controlled state is switched from the flow rate controlled state to a horsepower controlled state. In the horsepower controlled state, a horsepower control to reduce the pump volume as the pump discharge pressure P becomes higher is carried out as well as the first embodiment.

According to the embodiment described above, the following effects are achieved.

In the flow rate controlled state, the spool 41 is moved in the direction to increase the pump discharge pressure Pc as the flow rate controlling signal pressure Pi becomes higher. In the horsepower controlled state, the spool 41 is moved in the direction to increase the tilt driving pressure Pc as the pump discharge pressure P becomes higher.

In this manner, the negative flow rate control to reduce the pump volume as the flow rate controlling signal pressure Pi becomes higher is carried out in the flow rate controlled state.

The embodiments of the present invention have been described above, but the above embodiments are merely one of examples of application of the present invention, and the technical scope of the present invention is not limited to the specific configurations of the above embodiments.

For example, although the swash plate type piston pump is illustrated as the pump 100 in the embodiments described above, there is no limitation to this configuration, and any other variable displacement pump may be used.

Moreover, although the pump volume control apparatus provided in the pressure source of the hydraulic shovel is illustrated in the embodiments described above, there is no limitation to this configuration, and it is possible to apply the present invention to a pump volume control apparatus provided in any other machine, facility or the like.

The present application claims priority based on Japanese Patent Application No. 2013-070059 filed with the Japan Patent Office on Mar. 28, 2013, the entire content of which is incorporated into this specification by reference.

The invention claimed is:

1. A pump volume control apparatus configured to change a pump volume of a pump in accordance with a tilt angle of a swash plate, the pump volume control apparatus comprising:

a tilting piston configured to tilt the swash plate in a direction to reduce the pump volume as a tilt driving pressure becomes higher;

a pump volume switching valve configured to adjust the tilt driving pressure in response to a movement of a spool;

a flow rate control spring configured to bias the spool in accordance with the tilt angle of the swash plate;

a horsepower control piston configured to move in accordance with a pump discharge pressure of the pump;

a horsepower control spring configured to bias the horsepower control piston in accordance with the tilt angle of the swash plate; and a rod provided between the horsepower control piston and the spool, wherein the tilt driving pressure is adjusted by means of the movement of the spool in accordance with a force acting on the spool in response to a flow rate controlling signal pressure in a flow rate controlled state where a gap is formed between the rod and the spool, and wherein the tilt driving pressure is adjusted by means of the movement of the spool in accordance with a force acting on the horsepower control piston in response to the pump discharge pressure in a horsepower controlled state where the rod is in contact with the spool.

2. The pump volume control apparatus according to claim 1, wherein the spool is moved in a direction to increase the tilt driving pressure as the flow rate controlling signal pressure becomes higher in the flow rate controlled state, and wherein the spool is moved in a direction to increase the tilt driving pressure as the pump discharge pressure becomes higher in the horsepower controlled state.

3. The pump volume control apparatus according to claim 1, wherein the spool, the rod and the horsepower control piston are coaxially arranged.

4. The pump volume control apparatus according to claim 1, wherein the spool is moved in a direction to reduce the tilt driving pressure as the flow rate controlling signal pressure becomes higher in the flow rate controlled state, and wherein the spool is moved in a direction to increase the tilt driving pressure as the pump discharge pressure becomes higher in the horsepower controlled state.

5. The pump volume control apparatus according to claim 1, further comprising:

an adjuster spring configured to bias the horsepower control spring in a compression direction; and a horsepower controlling adjuster mechanism configured to adjust a spring force of the adjuster spring.

6. The pump volume control apparatus according to claim 1, further comprising:

a first pressure chamber defined by the horsepower control piston, the pump discharge pressure being introduced into the first pressure chamber; and a second pressure chamber defined by the horsepower control piston, a horsepower control signal pressure being introduced into the second pressure chamber, wherein the horsepower control piston moves the spool in a direction to reduce the tilt driving pressure as the horsepower control signal pressure becomes higher in the horsepower controlled state.

7. The pump volume control apparatus according to claim 1, wherein the pump volume switching valve includes:

a sleeve into which the spool is slidably inserted; and a pump volume switching adjuster mechanism configured to adjust a position of the sleeve.

8. The pump volume control apparatus according to claim 1, further comprising:

a retainer provided movably in an axial direction of the rod with respect to the rod; and a retainer moving mechanism configured to move the retainer as the swash plate tilts, wherein the horsepower control spring is interposed between the retainer and a jaw part of the rod, and wherein the flow rate control spring is interposed between the spool and the retainer.

9. The pump volume control apparatus according to claim 8, wherein the retainer moving mechanism includes a link that couples the tilting piston to the retainer.

10. The pump volume control apparatus according to claim 9, wherein the retainer moving mechanism includes a guide that slidably supports the link.

* * * * *